US007407326B2

(12) United States Patent
Wilkes

(10) Patent No.: US 7,407,326 B2
(45) Date of Patent: Aug. 5, 2008

(54) TRIANGULARLY SHAPED FLEXIBLE BOTTLE WITH FITMENT, AND METHOD OF FABRICATION

(76) Inventor: Kenneth R. Wilkes, 7 Stuyvesant Rd., Asheville, NC (US) 28803

( * ) Notice: Subject to any disclaimer, the term of this patent is extended or adjusted under 35 U.S.C. 154(b) by 602 days.

(21) Appl. No.: 10/731,855

(22) Filed: Dec. 8, 2003

(65) Prior Publication Data

US 2005/0123222 A1 Jun. 9, 2005

(51) Int. Cl.
*B65D 30/20* (2006.01)
*B65D 33/10* (2006.01)
*B65D 30/16* (2006.01)

(52) U.S. Cl. ..... 383/120; 383/7; 383/104; 383/906; 383/907

(58) Field of Classification Search ..... 383/33, 383/36, 104, 120, 123–126, 906–907, 7
See application file for complete search history.

(56) References Cited

U.S. PATENT DOCUMENTS

| | | | | |
|---|---|---|---|---|
| 3,367,380 A * | 2/1968 | Dickey | 383/104 |
| 3,380,646 A | 4/1968 | Doyen et al. | 229/57 |
| 4,669,124 A | 5/1987 | Kimura | 383/80 |
| 5,348,525 A | 9/1994 | Buchanan | 493/213 |
| 5,660,477 A | 8/1997 | Ichikawa | 383/80 |
| 5,918,984 A | 7/1999 | LaFleur et al. | 383/8 |
| 6,126,315 A | 10/2000 | Ichikawa et al. | 383/43 |
| 6,193,416 B1 | 2/2001 | Kawamata et al. | 383/104 |
| 6,220,702 B1 | 4/2001 | Nakamura et al. | 347/86 |
| 6,409,386 B1 | 6/2002 | Trani et al. | 383/120 |
| 6,832,852 B2 | 12/2004 | Wilkes | 383/120 |

* cited by examiner

*Primary Examiner*—Jes F Pascua
(74) *Attorney, Agent, or Firm*—Saul Epstein

(57) ABSTRACT

A triangularly shaped flexible bottle having a gusseted body section, and a neck section comprised of narrowed portions of the side panels and gusset of the body section, with a fitment in the neck section. The bottle has a flat bottom that may be created by tapering the webs forming the bottom at about 30 degrees. The body has a triangular cross section when filled, but may be contoured in the vertical direction. A process for fabricating the bottle is also disclosed which involves feeding webs, including a side gusset, creating perimeter seals around only the top portion of the bottle, inserting the fitment from the input end of the machine in the direction of web travel, forming the remainder of the perimeter seams, detaching the nascent bottle from the web, and sealing the neck section of the bottle to the fitment by clamping the neck section with a heated clamp, and preferably repeating the seal operation at a different radial angle. Sealing the fitment by application of ultrasonic energy is also disclosed.

14 Claims, 9 Drawing Sheets

TRIANGULARLY SHAPED FLEXIBLE BOTTLE WITH FITMENT, AND METHOD OF FABRICATION

BACKGROUND OF THE INVENTION

"Stand-up" plastic pouches or bottles for holding liquids and other pourable products are becoming more popular, in part because of the desire to minimize solid waste, in part because of cost, and in part for other reasons. An early stand-up pouch design (U.S. Pat. No. 3,380,646) was devised by the Doyen Brothers in France. That pouch design, including many variants, is still in use today. It is, in fact, the dominant style. The basic Doyen design consists of two flat sheets seamed together along their sides, with a "W" fold running along the bottom. When the pouch is filled, the "W" opens and provides a base on which the pouch can stand. The original Doyen design showed the top being sealed straight across, but subsequent modifications include fitments to allow the pouch to be reclosed after opening.

One difficulty in adding a fitment to a Doyen pouch (and to many other pouch designs as well) is that, according to prior art fitment sealing methods, the fitment must be of the "canoe" style to create a joint that can be reliably sealed. The canoe type of fitment is an attempt to minimize the change in direction of pouch material as it comes into contact with the fitment, and in so doing, improve the integrity of the joint where the two sides of the pouch come together at the fitment. However, even the use of a canoe shaped fitment does not completely solve the difficulties in sealing a fitment into a pouch, and a more reliable sealing means is desirable. The present invention, in one of its aspects, provides such a means.

A "canoe" style fitment is characterized by having a sealing surface that includes relatively sharp changes in direction around the sealing periphery so as to permit the pieces of material being sealed to the fitment to approach the fitment sealing surface (laterally) at relatively shallow angles. Or, put another way, as two webs separate to go around the fitment in opposite directions, the angle of divergence is relatively small. Canoe style fitments are illustrated in, e.g., U.S. Pat. No. 5,660,477, U.S. Pat. No. 4,415,085, and U.S. Pat. No. 4,732,299.

There are at least two other shortcomings of Doyen style pouches with fitments, as compared with the present invention. One is that, because the Doyen body tapers from the bottom to the top, and the present invention has a body that approximates a rectangular parallelepiped, for a given volume contained, the bottle of the present invention requires substantially less material to fabricate. Since material cost is a large part of the cost of flexible packaging, this is a significant factor. Another shortcoming of the Doyen style (and other ungusseted styles), compared to the present invention is that, because the upper body is fabricated from two flat sheets, when the pouch is partly full, the weight of the fitment tends to cause the top of the pouch to fold over, rather than stand erect.

Gusseted bottles (but without fitment) have been made in the past (see U.S. Pat. No. 6,193,416, Kawamata et al., U.S. Pat. No. 6,126,315, Ichikawa et al., and U.S. Pat. No. 5,918,984, LaFleur et al.) Obviously, without a fitment, these prior art containers do not have the utility of the present invention.

U.S. Pat. No. 5,660,477, Ichikawa, discloses a gusseted pouch with a fitment. The fitment shown has flanges protruding from the central section; these create even more sealing problems than a conventional canoe style fitment. Additionally, because of the way the top of the pouch is configured, i.e., the gussets are closed at the top, the fitment weight tends to cause this pouch to fold over when partly full, in a manner very much like a Doyen pouch with fitment.

SUMMARY OF THE INVENTION

The invented bottle which could, but preferably does not, utilize canoe style fitments is fabricated from flexible films (i.e., thin plastic, foil, paper, or the like) fed as webs from rolls of material. The bottle includes a gusseted body section that opens so as to form a triangular cross section. The gusset is terminated at the bottom of the bottle to form a substantially flat base, providing stability when the bottle is partially or wholly filled. The top portion of the bottle includes a fitment passing through a necked down portion of the bottle. The fitment is preferably sealed to the neck in two or more sealing operations carried out at different radial angles, preferably, but not necessarily, 90°, thus assuring an adequate seal between the fitment and the bottle neck around the entire periphery of the fitment.

For purposes of clarity, as pictured herein the fitment is illustrated without a closure. It will be appreciated that threaded, snap, and/or other types of closures are contemplated even though none is shown in the figures.

As opposed to requiring the use of canoe style fitments, as mentioned in the Background section of this Specification, the present invention permits, and preferably utilizes, "cylindrical base" fitments. The sealing surface (or "base") of a cylindrical base style fitment (as that term is used in the present application) is preferably (but not necessarily) substantially parallel to the axis of the fitment, as in the canoe style, but does not include external corners at sharply acute angles around its circumference, as do canoe style fitments. Rather, the circumference is preferably comprised of smooth and preferably convex curves. Having the circumference comprised of smooth curves is intended to facilitate the sealing of web material to the base of the fitment with two overlapping sealing steps applied from different directions. The cross sectional shape of the sealing area of a cylindrical base fitment is preferably circular, but may be oval, or have some other curved shape. While the word "cylindrical" is used herein to help define a "non-canoe" style of fitment, it should be understood that the fitment may be tapered somewhat (axially) to facilitate insertion or for other reasons.

Alternatively, instead of the sealing surface area of a cylindrical base fitment being comprised of smooth curves, the sealing surface of a cylindrical base fitment (as that term is used in this specification) may include intersections at an angle, provided that the angle is not so acute as to make a second sealing step difficult or impractical. Intersection angles that are greater than about 90° are generally deemed to be satisfactory, hence the term "cylindrical base", as used in this specification, refers to the base (i.e., the sealing surface) of a fitment wherein the webs of material surrounding and sealed to the fitment diverge at angles greater than about 90° as they separate to encircle the fitment. FIG. 15, which is a fragmentary sectional view of a cylindrical base fitment, illustrates the approximate minimum angle of approach of surfaces of what is termed here as a "cylindrical base" fitment. The base of a cylindrical base style of fitment could, for example, have a hexagonal shape (in cross section).

The preferred method of fabricating the invented bottle generally comprises:

1. feeding two or more webs of material in face to face contact into a fabricating machine, one of the webs being folded to form a gusset, 2. creating perimeter seals for the bottle around a part of the circumference, including the neck portion of the bottle, and shaping the bottle by cutting away areas at the edges of the webs,
3. separating at least one of the incoming webs from the remainder of the webs upstream of the neck portion and inserting a fitment into the neck portion of the bottle, the insertion motion being through what eventually will become the bottom of the bottle,
4. forming the remainder of the perimeter seals of the bottle,
5. severing the bottle from the web,
6. clamping the bottle material to the fitment with a heated clamping means to create a seal between the bottle material and the fitment,
7. Clamping the bottle material to the fitment with a heated clamp a second time, the second clamping being at a different radial angle.

DETAILED DESCRIPTION OF THE INVENTION

Figure 1A:
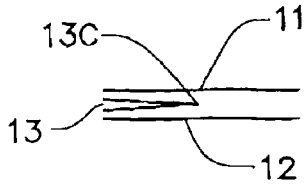
FIG. 1A is an exploded end on view of the webs of the constituent material as fed into the fabricating machine (one-up configuration).

The invented bottle is intended to be fabricated from webs of flexible heat sealable plastic, foil, paper, or similar material. Two or three webs may be involved in "one-up" fabrication, or two to four webs may be involved in "two-up" fabrication. The number of webs used in each case is a matter of convenience.

There are many different web material compositions that could be suitable for the invented bottle, depending on the circumstances, and all of the webs do not necessarily have the same composition. It may, for example, be desirable to have some portions of the completed bottle stiffer than others, which can be accomplished by having differing compositions, or by differing web thicknesses. Or, it may be desired that one or more faces of the bottle be foil, while the others are plastic. Other factors may also dictate differences in web composition.

In addition to any requirements that may be imposed on the materials by the proposed use of the bottle, in order to be amenable to the preferred method of manufacture as described below, a composite sheet is generally used. It is preferable that the sheets (or webs) have one heat sealable surface, and the other not heat sealable. In other words, the sheets used should be such that one face of a first sheet is heat sealable to an abutting face of a second sheet, whereas the second face of the first sheet will not form a bond to the second face of the second sheet (at least not at the temperatures and pressures used to bond the first faces). It will be appreciated that the preferred method of manufacture could be modified to permit the use of materials, both faces of which are heat sealable.

One material that has been found to work well for fabricating items such as the invented bottle is a polyester sheet having a coating of low density polyethylene on one face. Many other materials are also suitable, the one mentioned being merely illustrative. The low density polyethylene coating has the property of being able to be sealed to a like coating on another sheet, but the polyester base sheet will not seal to another sheet of polyester. This selective sealing property of the film used permits gussets in the web to be conveniently formed, (i.e., without sealing the inside faces of the gussets to each other), yet permitting other laminations to be sealed to the gussets, as will be described below.

In the description which follows, the invented bottle is described as though it were fabricated from three webs (in a "one-up" configuration), but it will be appreciated that it is contemplated that fabrication in accordance with the method described could be accomplished using as few as two webs. Or, alternatively, the bottle can be fabricated "two-up" using two to four webs. For descriptive purposes, the webs during the course of fabrication will be referred to as "top", "bottom", and "center", corresponding to their relative positions when passing through the first stages of fabrication. After fabrication, what were originally the top and bottom webs (sometimes called laminations), will form two side panels of the completed bottle, and will also form part of the top and bottom portions of the bottle. The center web (the gusset) will form the other side panel, and also be part of the top and bottom portions of the bottle. The neck, being a part of the top portion of the bottle, is formed from extensions of the front, back, and gusseted side panel.

FIG. 1A shows the relative positions of the various webs (in a "one-up" configuration) as they pass through the fabrication process. For clarity, the webs are shown separated and the seams not made. The constituent webs are top web 11, bottom web 12, and center web 13. The center web is folded, and forms a gusset in the finished product. The numeral 13C indicates the inner extent of the gusset fold.

While the webs 11, 12, and 13 are discussed herein as if they were separate pieces of material at the outset, it will be appreciated that any number of the seams between the webs could be "pre-made", as by folding one or more of the source webs to create the effect of a seam or seams. For example, if it were desired to fabricate the invented bottle from two webs instead of three, the bottom and center webs could be a single folded web, instead of two separate webs.

It will be appreciated that when the bottle is complete, and contains liquid, the gusset will be open, and the bottle will have a substantially triangular shape in cross section. Also, as will be noted below, even though the cross section is substantially triangular, the body of the bottle may be shaped with pleasing curves in the vertical direction. When partially or completely full, the invented bottle is remarkably stable.

The faces of the top and bottom webs 11 and 12 that are coated with sealable material, (i.e. the low density polyethylene in the case of the illustrative web material) face toward the interior of the bottle, whereas the coated face of the center web 13 faces outward of the gusset. Hence, it will be appreciated that when a sandwich including all of the webs is subjected to heat and pressure, only those faces which are coated with low density polyethylene will form seams, and the inside surface of the gusset (which is not coated) will not adhere.

Figure 2:
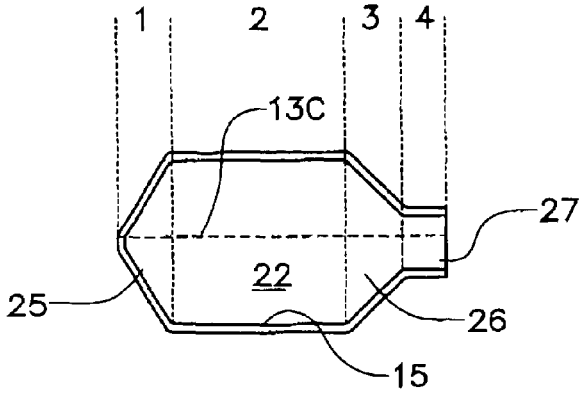
FIG. 2 is a flattened top view of a bottle according to the invention, without fitment.

FIG. 2 depicts the outline of a completed bottle, (except without the fitment), and with the gusset folded. What can be seen is top web 11, and the seam pattern 15. Section 1 is a portion of what will become the bottom, Section 2 is what will become the front panel, section 3 is a portion of the transition section, and section 4 is a portion of the bottle neck (where the fitment is placed). The dashed line 13C indicates the fold of the gusset. The edges of the webs at section 1 preferably taper inward at approximately a 30° angle, terminating at approximately the inside edge of the gusset. Alternatively, the bottom could be cut straight across, without the 30° cuts. A bottle made in this manner would unfold to a flat bottom, as does the 30° cut embodiment, but it has been found that such a bottom does not contribute to quite as stable a structure as does the 30° cut bottom.

Figure 3:
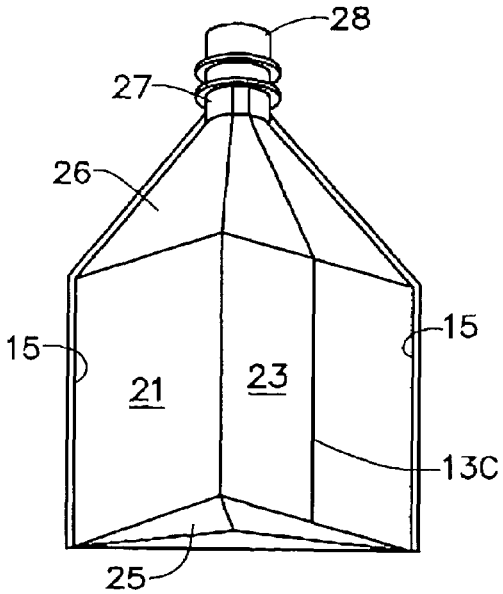
FIG. 3 is a trimetric view of a completed and filled bottle according to the invention.
Figure 3A:
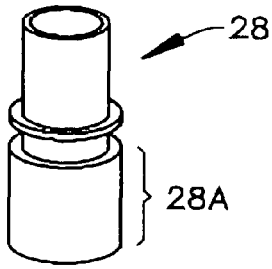
FIG. 3A is a trimetric view of a representative fitment for use in the invented bottle.

FIG. 3 is a trimetric view of one embodiment of a completed bottle as it would appear filled (partially or completely) with liquid or other flowable product. Side panel 21 (a part of web 11 during fabrication) is visible, as is transition section 26, neck 27, and fitment 28. The gusset 13 which was the center web 13 during fabrication can be seen as side panel 23. The other side panel (22) cannot be seen. FIG. 3A is a trimetric view of a representative fitment 28, with the numeral 28A indicating the base of the fitment. A round base is illustrated, but as noted above, other shapes are also contemplated.

A presently preferred method of fabricating the invented bottle is illustrated in FIGS. 4 through 9. The "A" portion of each figure is a plan view showing the webs at a particular stage in the fabrication process as the webs pass through the fabricating machine, while the "B" portion is a side view. In order to promote clarity, all figures are somewhat schematic in nature. Since fabrication is a continuous repetitive process, the point in the process where explanation starts is somewhat arbitrary.

In general terms, the fabrication process proceeds as follows:

1. The perimeter seams which form the top portion of a bottle are formed (by the application of heat and pressure, or alternatively by ultrasonic or other means), and at the same time the extra material around the neck and the transition section is removed by "notching" the edges of the webs.
2. The fitment is inserted.
3. The partially formed bottle is then moved forward and attached to a suitable transport mechanism, for example the "turret" illustrated in the drawings.
4. The remainder of the perimeter seams are formed (i.e., the bottom portion—as well as the top portion for the next bottle) and the bottle is detached from the web.
5. The nascent bottles are moved to the next station (i.e., the turret is rotated) and the joint between the neck of the bottle and the fitment is sealed in two operations, the bottle being turned (preferably about) 90 degrees between sealing operations. Alternatively, of course, the sealing mechanisms (or possibly a single mechanism) could apply the pressure from differing angles.

Figure 4A:
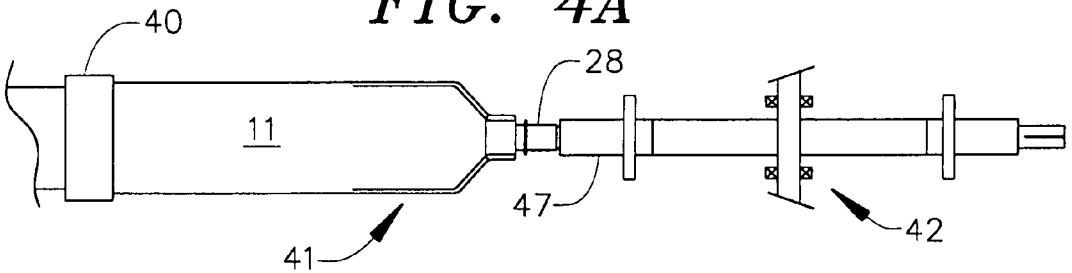
FIGS. 4 through 9 are schematic views of various steps of the presently preferred fabricating process, as performed in a fabricating machine. The Figures marked "A" are top views of the web during the process step, whereas those marked "B" are side views at the same point in time.
Figure 4B:
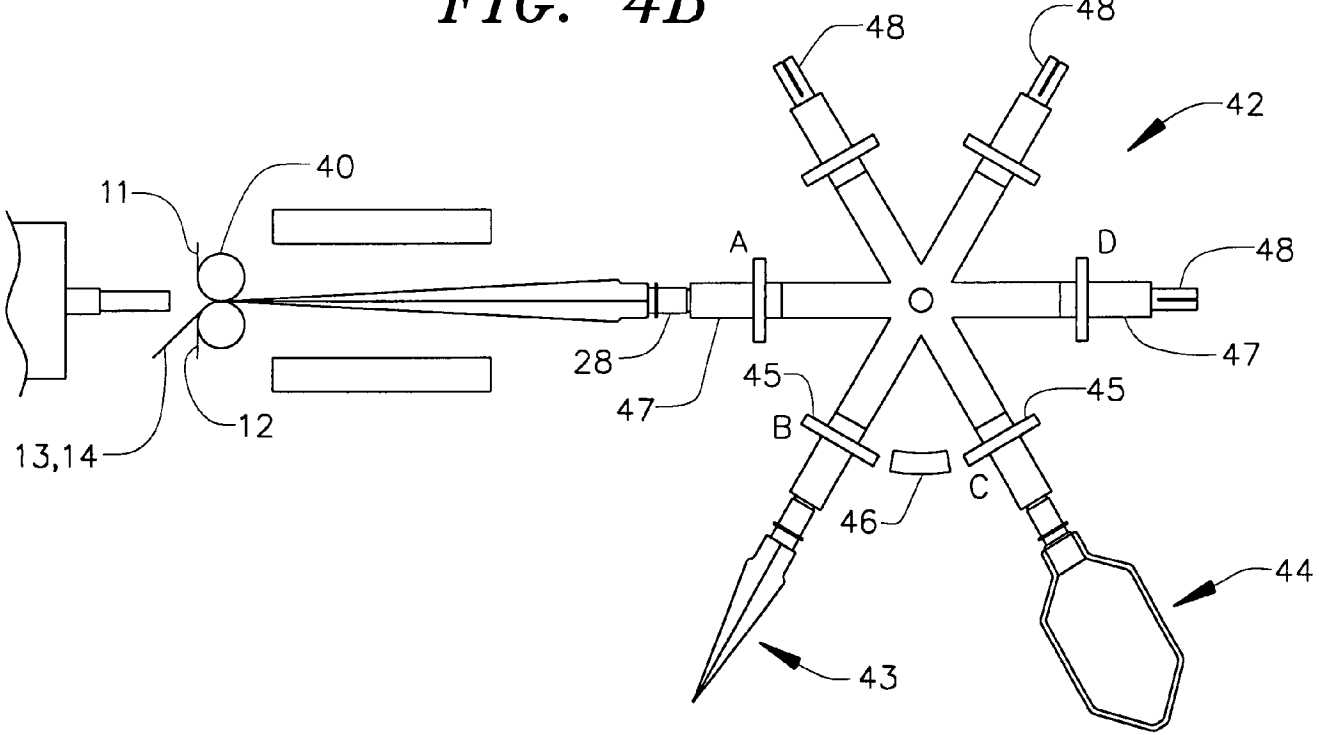

For greater detail of the fabrication process, first refer to FIG. 4, where the webs 11, 12, and 13 are seen being fed into the fabricating machine around a pair of idler rolls 40. A first nascent bottle 41 is seen being held at the end of an arm 47 of turret 42 at station A (the holding means (48) will be described later). At the time depicted in FIG. 4, the top portion of the perimeter seams for bottle 41 have been formed, and the fitment 28 has been placed, but the bottom portion of the bottle is still unseamed. Partially completed bottles 43 and 44 are attached to the turret at stations B and C. Turret 42 is rotatable by means not shown.

Figure 5A:
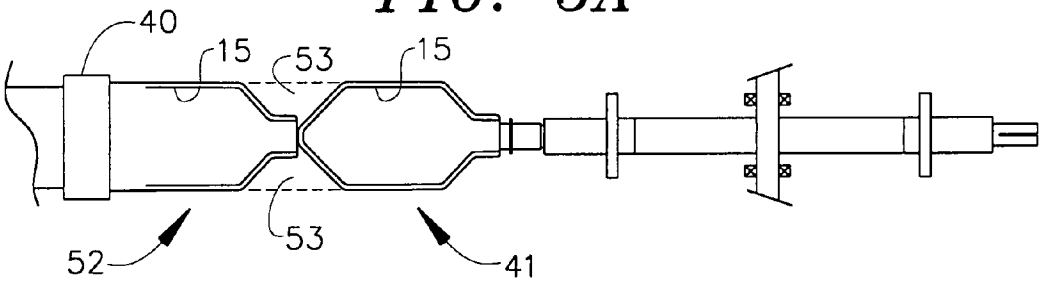
Figure 5B:
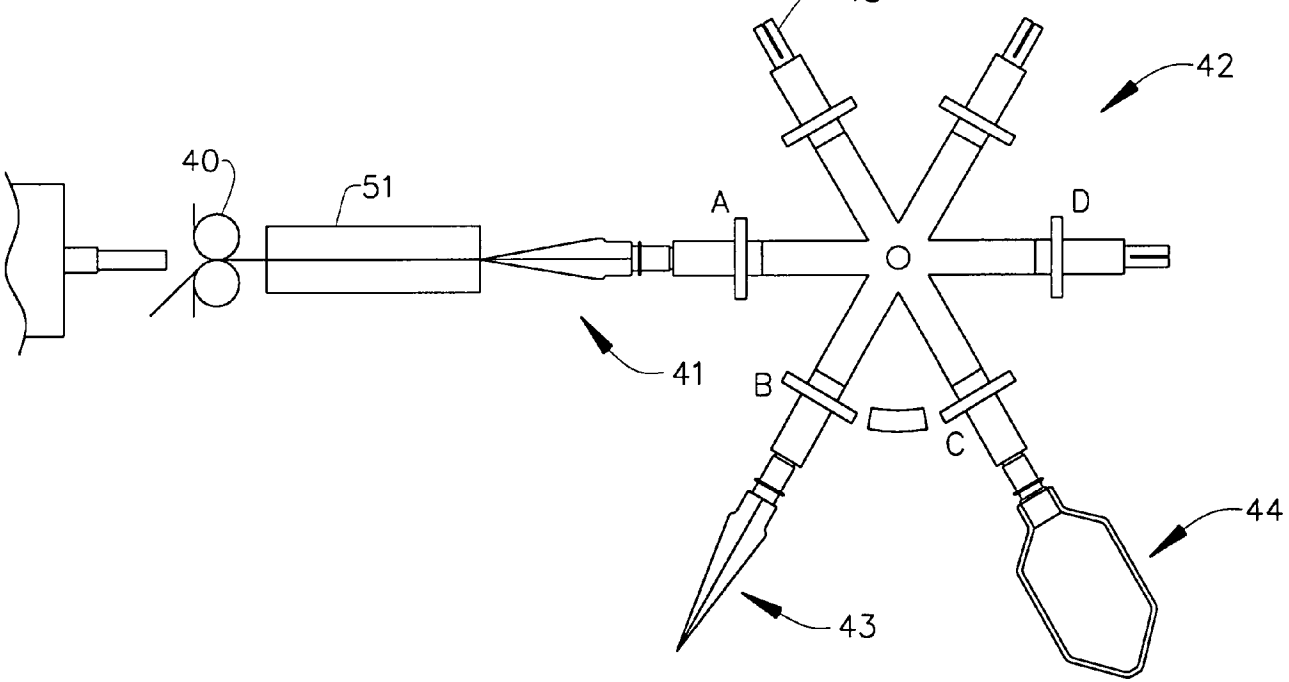

The next step, as shown in FIG. 5, seaming iron 51 has closed on the web, and is forming the top portion of the perimeter seams (15) for the next bottle (52), as well as the bottom portion of the perimeter seams for the bottle 41. When seaming iron 51 clamps the webs together, as noted previously, the inside surface of the gusset (not being coated) will not adhere, but seams will be formed between the gusset material and the top and bottom webs (since these abutting faces are coated with sealable material).

Figure 10:
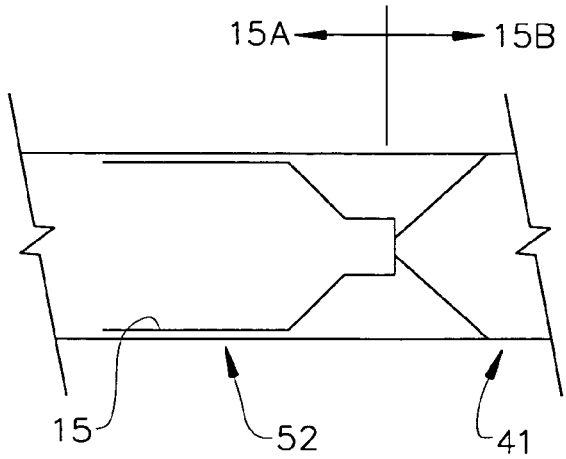
FIG. 10 depicts a seam pattern made by the seaming iron in accordance with one embodiment of the fabricating machine.

FIG. 10 illustrates an exemplary pattern of the perimeter seams 15 formed by seaming iron 51. The numeral 15A indicates the seams for the top portion of one bottle, while 15B indicates the seams for the bottom portion of the prior bottle. For clarity, only the seams made at one closing of seaming iron 51 are shown in the figure.

At the same time as the perimeter seams are being formed by seaming iron 51 (as illustrated in FIG. 5), a notching means—which may be integral with the seaming iron—cuts the extraneous material (indicated by the numeral 53) from around the neck and transition areas of the bottle being formed, and also severs the web between bottles 41 and 52. The extraneous material (53) is commonly removed from the area by a vacuum system, and is discarded.

Figure 6A:
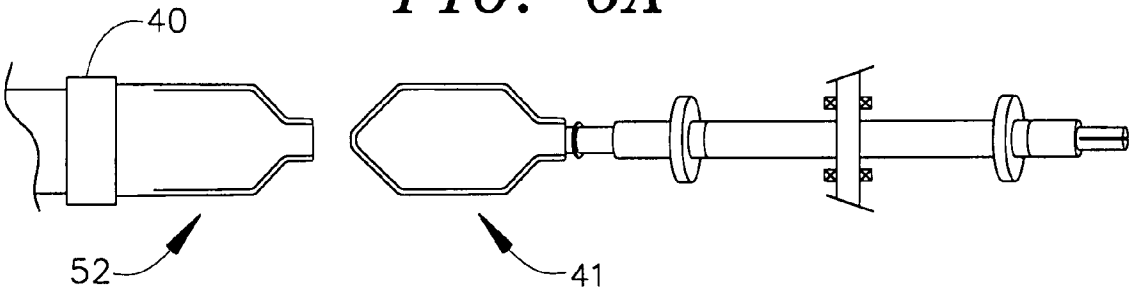
Figure 6B:
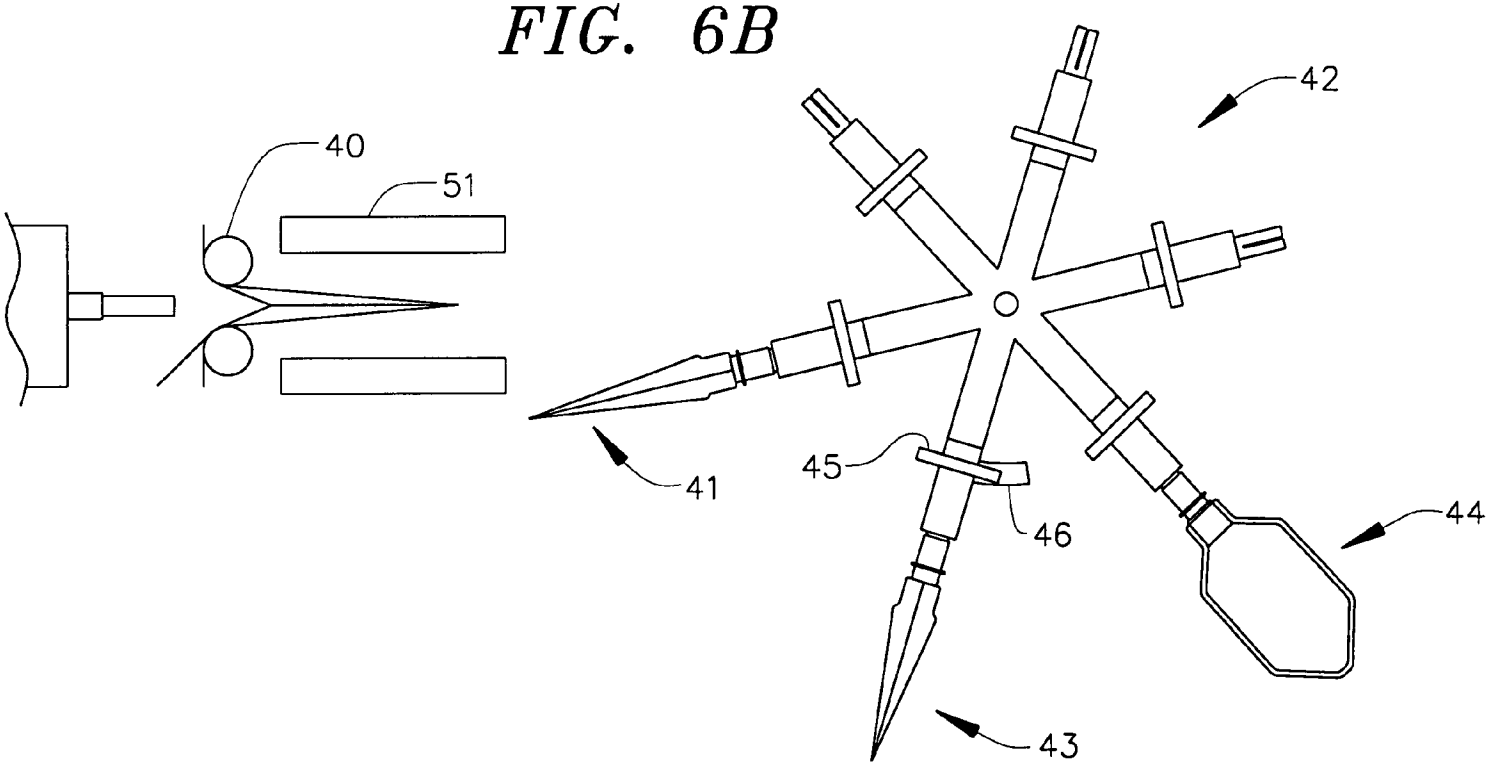

After the perimeter seams have been formed as described in the preceding paragraphs, and the web severed, the turret is rotated so that bottle 41, which was at station A, is rotated 60° (counterclockwise as viewed in the drawings) to station B. As the turret rotates, the seaming iron 51 members separate, as do the rollers comprising idler rolls 40. This is illustrated in FIG. 6.

Figure 7A:
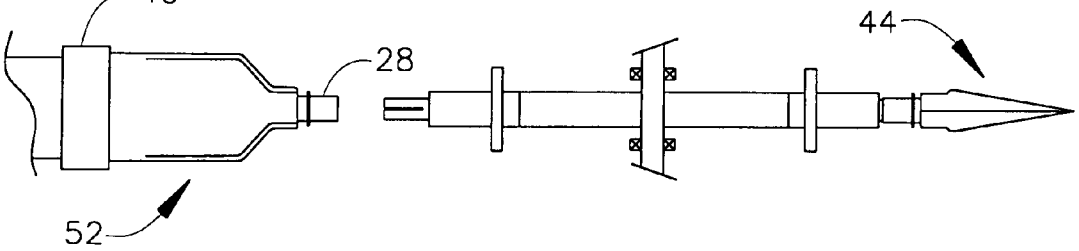
Figure 7B:
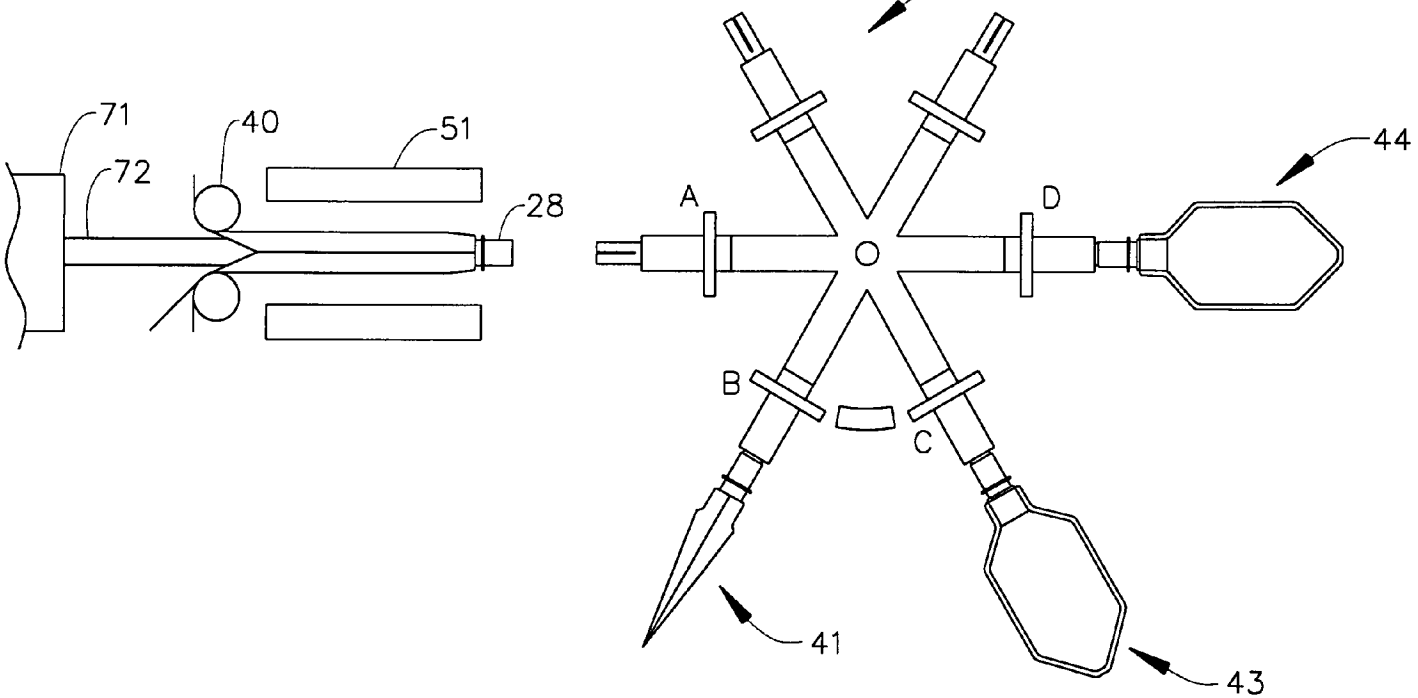
Figure 8A:
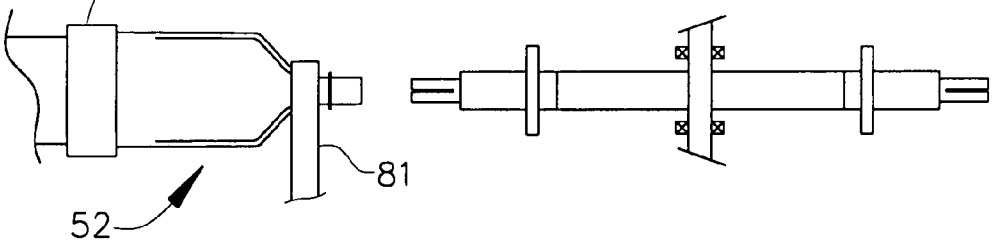
Figure 8B:
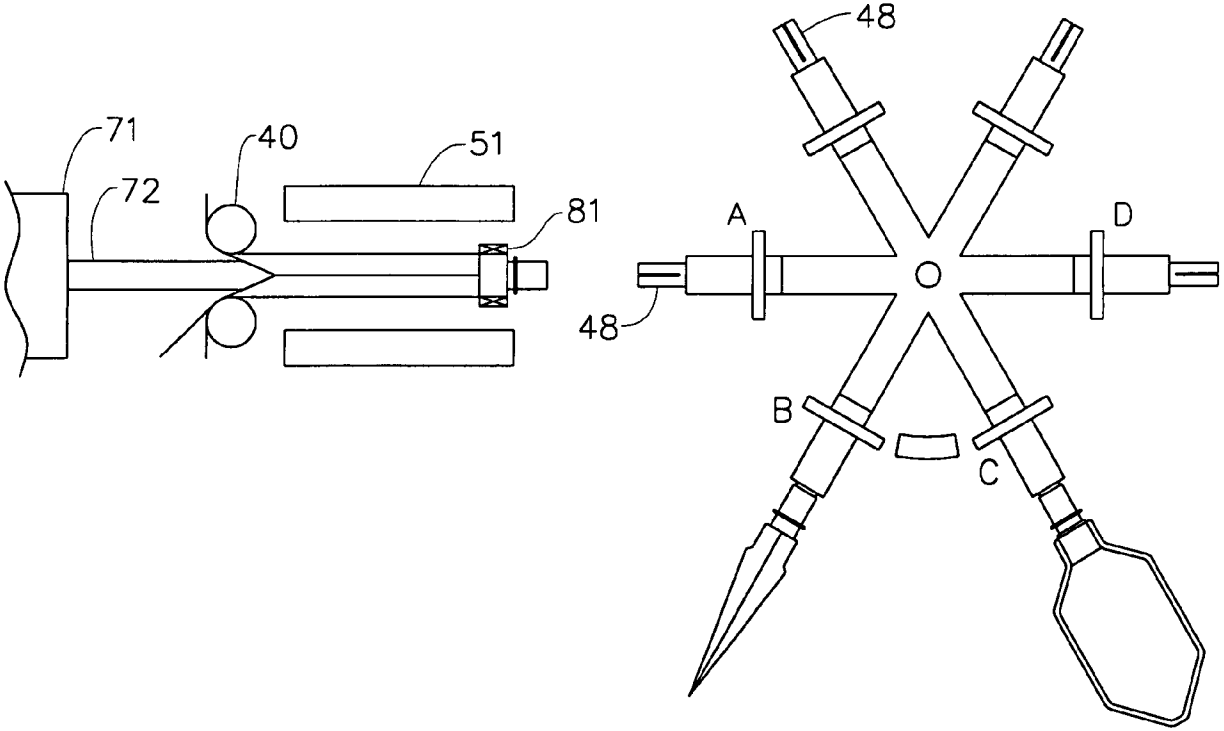
Figure 9A:
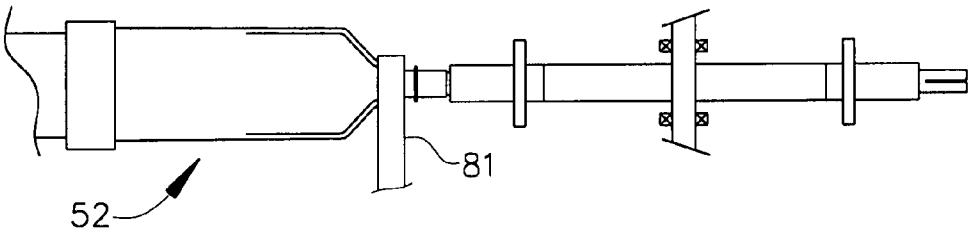
Figure 9B:
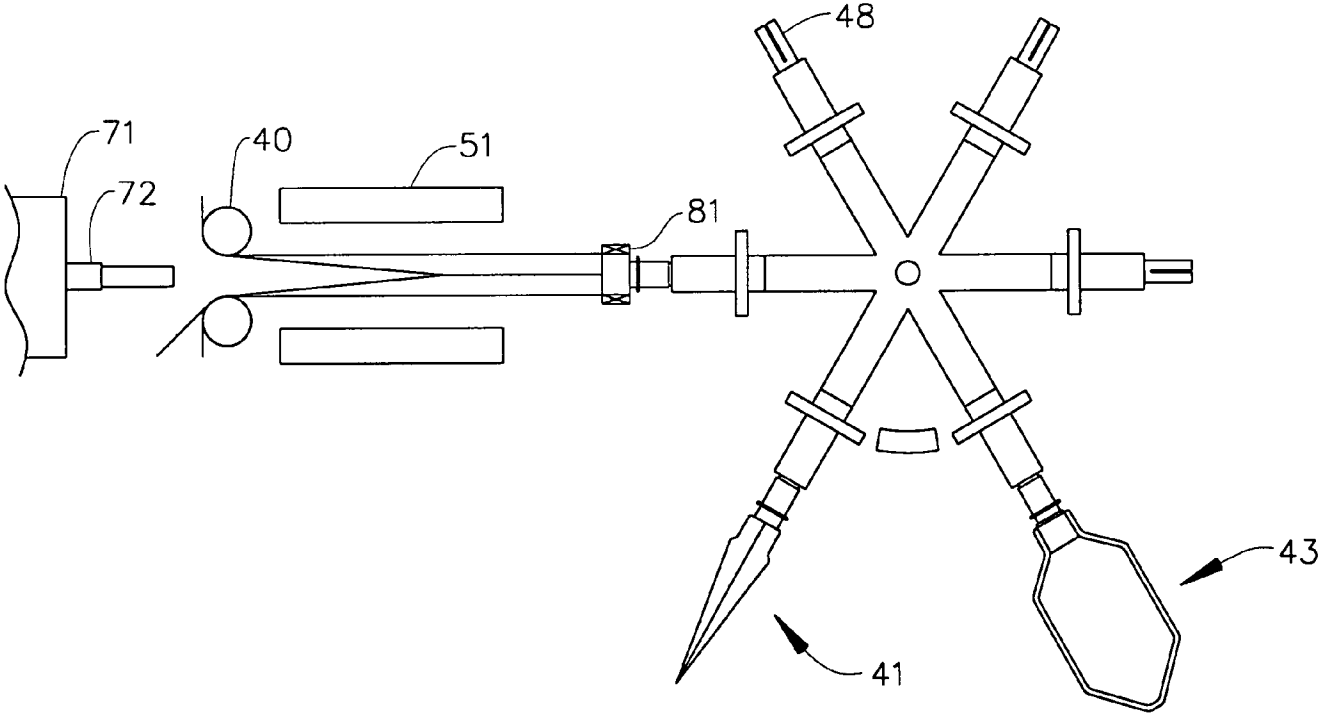

When the idler rolls 40 are far enough apart, fitment driver 71 drives mandrel 72 (which has a fitment 28 positioned on its end) in through the open bottom of the bottle in process, and positions the fitment in the neck portion of the bottle (FIG. 7). Fitment handling and positioning on the mandrels such as mandrel 72 is known in the art and therefore is not further described. The fitment should fit reasonably closely to the neck portion of the bottle so that wrinkles do not appear when the neck is sealed to the fitment. The maximum looseness of fit depends in great measure on the particular circumstances, but in general, if the inner circumference of the neck is more than about 3% larger than the circumference of the base of the fitment, there is a danger of wrinkling. It may be desired to taper the base of fitment 28 somewhat as an aid to fitting it into the neck, After the fitment 28 is in place, clamp 81 (FIG. 8) clamps the bottle neck 27 to the fitment 28. Clamp 81 is preferably heated so that a first (at least temporary) bonding of the bottle material to the fitment is accomplished. Clamp 81 is then moved to engage the fitment with an arm of the turret (FIG. 9). The end 48 of the arm on which the bottle is held, is preferably split, is compliant, and has a slightly larger diameter at its end than the hole in the fitment (so as to hold the fitment from the inside). As the clamp 81 moves the nascent bottle to the position shown in FIG. 9, the idler rolls 40 turn as the material feeds.

After the bottle is in position and held by end 48, mandrel 72 is retracted. The clamp 81 is then released and moved back to its at rest position and a new fitment is positioned on the end of mandrel 72 (not illustrated).

At the end of the step described in connection with FIG. 9, the nascent bottle 52 that is held by an arm of the turret at station A is in same condition as bottle 41 was just before the step described in connection with FIG. 4. The next step, therefore, is to repeat the step of FIG. 4 by closing the idler rolls 40, following which the seaming iron 51 will create another set of perimeter seals, etc.

Stepping back to the time just after the rotation of the turret 42 to the position shown in FIG. 7, bottles 41, 43, and 44 can be seen attached at the ends of the arms 47 of the turret at stations B, C, and D. Bottle 44 is pulled off the turret leg at this time (by means not shown) and transferred to a packing station or to a bottle filling station.

Figure 11A:
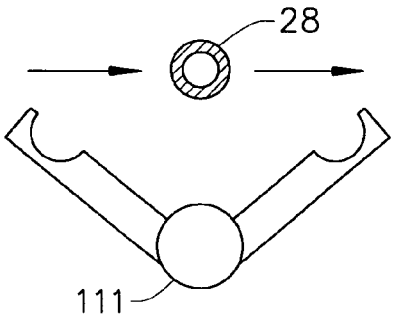
FIG. 11A is a top view of the seaming clamp used to create a seal between the bottle neck and the fitment, in an open condition.
Figure 11B:
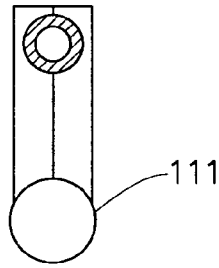
FIG. 11B is a top view of the seaming clamp used to create a seal between the bottle neck and the fitment, in the closed condition.

A heated clamp 111 (as shown in FIGS. 11A and 11B) is located at each of stations B and C. When the turret is stopped during the steps of FIGS. 7, 8, 9, 4, and 5, both clamps 111 are closed around the base 28A of fitment 28 of the bottles which are then at stations B and C, as indicated in FIG. 11B, creating seals between the neck and the fitment. Just before the turret begins to turn again (FIG. 7), the clamps open (FIG. 11A) to allow the turret to move. For clarity, the clamps 111 are not shown in FIGS. 4-9.

Alternatively, instead of using heat and pressure, as applied by heated clamp 111, to seal the bottle neck to the fitment, the seals can be effected by applying ultrasonic energy to the interface. Similarly, the perimeter seams also may be made by using ultrasonic energy. Ultrasonic sealing is well known, and need not be described further.

The ends of the turret arms 47 are rotatable with respect to the arms, and, to effect such rotation, each end includes a gear or friction wheel 45 that engages a mating rack or friction pad 46 fastened to the machine frame between stations B and C. The length of the rack 46 is such that each arm end (and attached bottle) turns about 90° between stations B and C. The heated clamps 111 at stations B and C (which are heated hot enough, and apply sufficient clamping pressure to form a seal between the web material and the fitment) therefore provide a uniform seal between the neck of the bottle 27 and the fitment 28 around the circumference.

The use of two heated clamps to apply pressure to the sealing area at different radial angles assures that the needed sealing pressure is exerted on the fitment at all areas around the entire circumference, and thereby provides complete and reliable sealing. It will be appreciated that since clamp 81 can be utilized to provide the first sealing step, adequate two-step sealing can be achieved, if desired, using only clamp 81 and one clamp 111. In such case, turning of the bottle between sealing steps would not be necessary.

As an alternate, instead of turning the bottles, two clamps 111 could be positioned so as to apply clamping force from different directions. Yet another alternate method of sealing, that would be suitable for use with symmetrical fitments, would be to use only one heated clamp, actuating it twice, and causing it move angularly between actuations.

Figure 12:
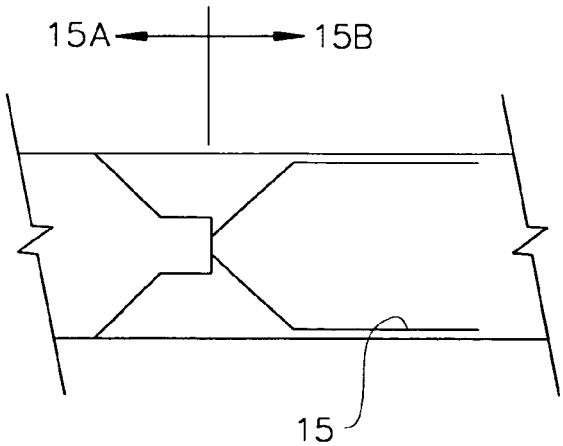
FIG. 12 depicts an alternate seaming pattern made by the seaming iron.

FIG. 12 depicts an alternate configuration of the seaming pattern for the perimeter seams. In the case of FIG. 12, the portion 2 (as shown in FIG. 2) is formed at the same time as portion 1 is formed, rather than at the time portions 3 and 4 are formed. Forming the seams in this manner will involve some differences in timing of the process, as will be apparent to those skilled in the art, but can be accommodated, if deemed convenient.

Figure 13:
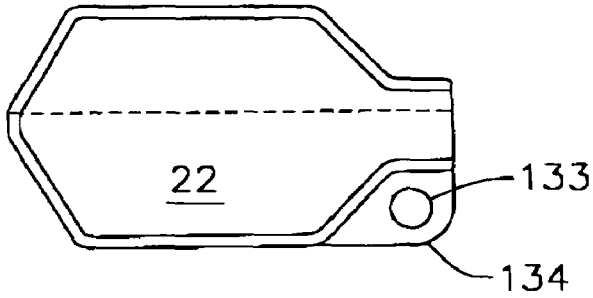
FIGS. 13 is a flattened plan view of an alternate embodiment of the invented bottle that includes a handle portion.

FIG. 13 shows a flattened bottle as in FIG. 2, but with a handle 134 adjacent to the neck portion. Hole 133 provides a place to hook a finger so as to enable a user to easily hold the bottle.

Figure 14:
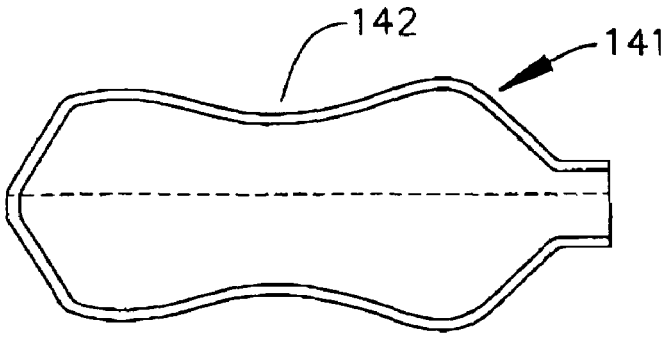
FIG. 14 is a plan view of a flattened bottle according to another embodiment of the invention, without the fitment.
Figure 15:
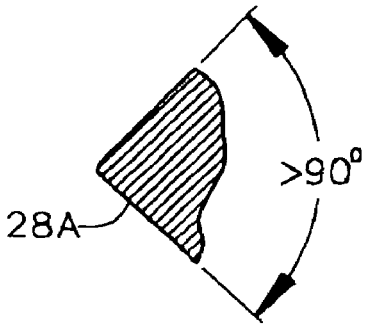
FIG. 15 is a fragmentary sectional view of the base section of a fitment which could be used in connection with the invention.

FIG. 14 is intended to show that the body of the invented bottle need not be simply cylindrical (when filled). While a horizontal cross section of the body is triangular, the body (vertically) may have a pleasing shape, as illustrated in FIG. 14, where a bottle 141 is shown with its sides notched out (as indicated by the numeral 142) providing an "hour glass" or other desirable shape. The notching preferably is accomplished at the same time as material 53 is cut away. The bottle of FIG. 14 is shown in the same condition as the bottle of FIG. 2, namely flat, and without fitment inserted.

For explanatory purposes, FIGS. 4-9 and 13 show a "turret" type of device for holding the bottles at spaced stations A, B, C, and D, and transporting them between stations. It will be appreciated by those skilled in the art that other suitable transport means could be used to accomplish the same function, i.e., a chain running around a pair of sprockets, a carousel, pallets travelling down a track, or other means.

Figure 1B:
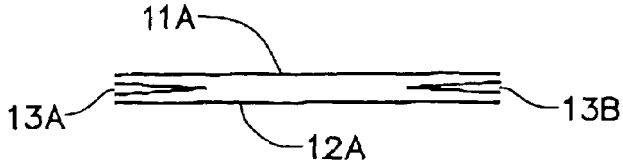
FIG. 1B is an exploded end on view of the webs of the constituent material as fed into the fabricating machine (two-up configuration).

At the outset, reference was made to the possibility of fabricating the invented bottle "two-up". FIG. 1B depicts a web configuration that could be used for "two-up" production. Webs 11A, and 12A correspond to webs 11 and 12 of FIG. 1A, but two gussets 13A and 13B are shown instead of the single gusset 13 of FIG. 1A. It will be appreciated that by slitting the web configuration depicted in FIG. 1B down the middle, two webs of the configuration shown in FIG. 1A will be created. Hence, the web configuration shown in FIG. 1B can result in two lines proceeding side by side, utilizing two turrets, two fitment arms, etc. Of course, at some point during fabrication, preferably just before attachment of the nascent bottles to the turret, the web must be slit into two parallel webs. Slitting webs is a common procedure in the art, and, accordingly, need not be discussed in detail.

What has been described is a novel flexible bottle, with a fitment, and a method for fabricating same. These have been described in detail with reference to specific embodiments. Persons skilled in the art will, no doubt, utilize the principles disclosed herein in connection with embodiments differing in some details from those described, but nevertheless within the spirit of the invention as defined in the below claims. Such changed embodiments, as well as such changes in the process of making the invented bottle as will occur to those skilled in the art, are intended to be covered by the following claims, which define the invention.

I claim:

1. A triangularly shaped bottle fabricated from flexible webs and including a fitment which comprises:

a bottom section;

a body section comprising a front side panel, a rear side panel, and one gusseted side panel, each of said front side panel, rear side panel and gusseted side panel having predetermined widths;

a neck section formed from extended portions of said front and rear side panels and extended portions of said gusseted side panel, the widths of said extended portions of said front and rear side panels and said gusseted side panel being reduced at said neck section;

a tapered transition section between said body section and said neck section; and a fitment positioned within said neck section, and sealed to said extended portions of said front and rear side panels and to said extended portions of said gusseted side panel.

2. A triangularly shaped bottle as recited in claim 1 wherein said neck section is sealed to said fitment by applying heat and pressure to said neck section against said fitment at least two times and from at least two different angular directions.

3. A triangularly shaped bottle as recited in claim 2 wherein at least two of said applications of heat and pressure are applied from directions which differ by about 90 degrees.

4. A triangularly shaped bottle as recited in claim 1 wherein said neck section is sealed to said fitment by applying ultrasonic energy to the interface between said neck section and said fitment.

5. A triangularly shaped bottle as recited in claim 1 wherein the side edges of said front side panel, said rear side panel, and said gusseted side panel are contoured.

6. A triangularly shaped bottle as recited in claim 1 wherein said bottom portion is formed from extended portions of said front and rear side panels and said gusseted side panel, the edges of said extended portions tapering at an angle of about 30 degrees.

7. A triangularly shaped bottle as recited in claim 1 and further including a handle portion extending from said transition and neck sections.

8. A triangularly shaped bottle fabricated from flexible webs and including a fitment having a cylindrical base which comprises:

a bottom section;

a body section comprising a front side panel, a rear side panel, and one gusseted side panel, each of said front side panel, rear side panel and gusseted side panel having predetermined widths;

a neck section formed from extended portions of said front and rear side panels and extended portions of said gusseted side panel, the widths of said extended portions of said front and rear side panels and gusseted side panel being reduced at said neck section;

a tapered transition section between said body section and said neck section; and a fitment having a cylindrical base positioned within said neck section, said cylindrical base being sealed to said extended portions of said front and rear side panels and to said extended portions of said gusseted side panel.

9. A triangularly shaped bottle as recited in claim 8 wherein said neck section is sealed to said cylindrical base by the application of heat and pressure.

10. A triangularly shaped bottle as recited in claim 9 wherein said heat and pressure is applied more than one time, and at least two of said applications of heat and pressure are applied from directions which differ by about 90 degrees.

11. A triangularly shaped bottle as recited in claim 8 wherein said neck section is sealed to said fitment by applying ultrasonic energy to the interface between said neck section and said cylindrical base.

12. A triangularly shaped bottle as recited in claim 8 wherein the side edges of said front side panel, said rear side panel, and said gusseted side panel are contoured.

13. A triangularly shaped bottle as recited in claim 8 wherein said bottom portion is formed from extended portions of said front and rear panels and said gusseted side panel, the edges of said extended portions tapering at an angle of about 30 degrees.

14. A triangularly shaped bottle as recited in claim 8 and further including a handle portion extending from said transition and neck sections.

* * * * *